United States Patent [19]

Bricknell

[11] Patent Number: 4,554,526

[45] Date of Patent: Nov. 19, 1985

[54] FLUORESCENT LAMP WITH IRON-NICKEL BIMETAL FILAMENT SWITCH

[75] Inventor: Rodger H. Bricknell, Schenectady, N.Y.

[73] Assignee: General Electric Company, Schenectady, N.Y.

[21] Appl. No.: 643,577

[22] Filed: Aug. 23, 1984

[51] Int. Cl.[4] ..... H01H 37/52

[52] U.S. Cl. ..... 337/379; 337/109

[58] Field of Search ..... 337/379, 109

[56] References Cited

U.S. PATENT DOCUMENTS 4,041,432 8/1977 Yarworth et al. ..... 337/379

*Primary Examiner*—Harold Broome

*Attorney, Agent, or Firm*—Paul E. Rochford; James C. Davis, Jr.; James Magee, Jr.

[57] ABSTRACT

An improved thermally responsive switch is provided. The switch has a thermally movable arm which moves a substantial degree at a selected response temperature but which moves only a small degree at higher temperatures and also at lower temperatures.

4 Claims, 5 Drawing Figures

FLUORESCENT LAMP WITH IRON-NICKEL BIMETAL FILAMENT SWITCH

BACKGROUND OF THE INVENTION

The present invention relates generally to fluorescent lamps having starter filaments and to the conservation of energy used in operation of such lamp filaments and lamps. More specifically it relates to means and method for eliminating the power to the lamp filaments once the lamp is in operation but also permitting rapid start after shutoff.

It is known that fluorescent lamps have filaments connected at each end of the lamp external contact members. These external contacts supply power through the filament and heat it during the operation of fluorescent lamps.

The heating of the filament helps the emission of electrons from the cathode and helps to initiate the formation of the fluorescent plasma within the lamp. However, once the gas within the fluorescent tube is ignited into a plasma the continued heating of the filament is not necessary. This continued heating of the filament consumes approximately 10% of the energy consumed by an ordinary fluorescent lamp of about 30 watts during its operation.

It has been previously conceived to provide a switch which can be located in and operate in the internal portion of conductive leads extending through the lamp envelope. Such conductive leads extend into the enclosure of the lamp and extend from the interior of the lamp envelope to opposite ends of the lamp filament. This internal switch opens and closes responsive to the level of heating of the filament. Once a filament has been heated by the electric current and the fluorescent plasma has been started, the discharge causes a continued heating of the filament so that a switch responsive to heat of the filament will remain open while the fluorescent plasma remains on within the envelope of the fluorescent tube. This is a well developed art and the original patent on thermally responsive switches in fluorescent lamps has now expired.

Bimetal metallic strips are used as the heat sensitive and heat responsive moveable element of the switch. However, there are several problems associated with the use of conventional bimetallic strips in a heat responsive switch type of application.

For fluorescent lamp filament current switching, the switch is required to open at about 200° C. To achieve this thermal opening, a preset stress opposing the opening might conventionally be mechanically applied by bending the contact wire to bias the bimetal strip into a closed position pressing against a stationary contact wire.

However, storage of such lamps as in unheated warehouses will lead to thermally induced stresses in the bimetal strip which will greatly add to the preset stresses applied when applied as the switch is manufactured.

Similarly, the use of the fluorescent lamp out-of-doors in winter will lead to similar induced stresses. Further, the manufacture of the fluorescent lamp itself results in heating of the lamp and its parts to about 500° C. This is the annealing temperature during manufacture. This heating also leads to the development of large stresses in the mechanism which is to serve as the switch during normal operation of the lamp.

The conventional and commercially available bimetallic strips have different patterns of deflection relative to temperature and some of these are plotted in FIG. 3 of the accompanying drawings. In this drawing, the material designations are those given by the manufacturer, Texas Instruments, and where the letter refers to the material with the higher coefficient of thermal expression and the number to the material of lower expansivity. It will be seen from the Figure that the sample B3, for example, undergoes very substantial deflection over the temperature range of 100° below zero centigrade (i.e. −100° C.) to 500° or 600° C. Very large deflections of such strips are accompanied by the imparting of very large stresses to the strips themselves. Such large stresses leads to concern regarding creep and fatigue failures.

Lower deflections and stresses can be obtained by employing a material such as that illustrated as E5. However, such materials having a shallower pattern of deflections relative to temperature have the disadvantage of moving slowly in the use temperature range of about 200° C. and this leads to a different problem, namely "chatter". The chatter occurs when the opening and closing of the switch is the subject of less definite motion so that successive openings and closings (or chatter) occur as the temperature passes through the level at which the opening or closing will occur.

As an alternative, there is illustrated a material, N1, in FIG. 3 which does have a relatively flat pattern at the upper temperatures but which has substantially greater deflection even than the B3 material at the lower temperatures. Such large deflection results in large stresses and defeats the purpose of the switch that is in operation.

Reproducible operation at the desired temperature without interference from the high stresses developed either at high or low temperatures is desired. Referring here to FIG. 4, there is illustrated an idealized representation of what might be termed an ideal or perfect bimetallic strip and strip behavior for the switching application relative to the power saving for a fluorescent lamp. This ideal behavior is achieved by employing materials which display a differential coefficient of thermal expansion as follows:

$$\Delta\alpha = \alpha_1 - \alpha_2$$

where the value of $\Delta\alpha$ is zero at all temperatures except at the intermediate temperature range where the opening of the switch is required.

$\Delta\alpha$ is the differential coefficient of thermal expansion.

With a pattern such as that illustrated by the solid line in FIG. 4, i.e. a pattern in which there are no deflections outside of the use temperature, no stresses are produced outside this temperature region, either at high temperatures or at low temperatures.

BRIEF DESCRIPTION OF THE INVENTION

Accordingly it is one object of the present invention to provide an improved heat sensitive switch for use within a fluorescent lamp.

Another object is to provide an improved means for suspending the flow of current through the filament of a fluorescent lamp after it has been initially ignited.

Another object is to provide a fluorescent lamp having an improved energy saving switch which saves approximately 10% of the energy normally consumed in operation of such a fluorescent lamp.

Another object is to provide an improved switch having rapid and reliable operation and response to temperature change.

Another object is to provide a switch for use within a fluorescent lamp to switch off the current to the filament once the fluorescent plasma has been ignited and which switch responds quickly to cooling to close the switch after the plasma has been extinguished.

Other objects and advantages of the invention will be in part and in part pointed out in the description which follows.

In one of its broader aspects, objects of the invention can be achieved by proceeding an improved bimetal and incorporating the improved bimetal in a thermally responsive switch of a fluorescent lamp. The improvements include significantly lower total stress ranges and rapid deflection characteristics at the opening temperature.

BRIEF DESCRIPTION OF THE DRAWINGS

The manner in which the invention may be practiced will be better understood by reference to the accompanying drawings in which.

DETAILED DESCRIPTION

Figure 1:
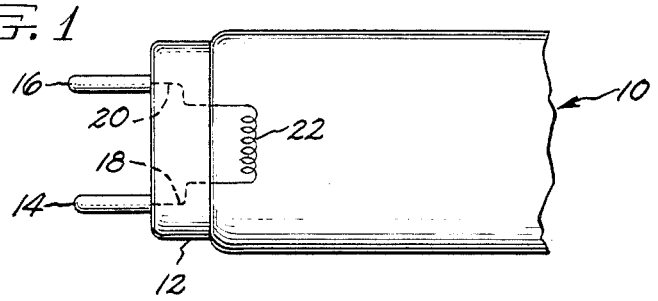
FIG. 1 is an elevational view of the end of a conventional fluorescent tube.

In FIG. 1, there is illustrated an end of a conventional fluorescent lamp with some electrical parts shown in phantom. The lamp is the type of lamp with which the switch of the present invention can be used. The lamp includes a glass envelope 10, only a portion of which is shown. It also includes a conventional metal end cap 12 and two prong contacts 14 and 16 extending in insulated relation from the end of the tube. Two conductors 18 and 20 provide a conductive path from the blades 14 and 16 respectively to a resistance heatable filament 22. In normal operation, the heating of the filament 22 is accomplished by applying a voltage from one of the prongs to the other from an external source of power not shown. The filament becomes heated as current flows through it. In the hot condition the filament assists in initiating conduction through the gas in the tube to a similar filament at the other end of the tube, not shown.

Returning now to FIG. 2, there is illustrated one configuration of a thermally responsive switch. In this switch the power is supplied through the two electrical leads 30 and 32. The lead 30 is electrically connected through conductor 34 to filament 36 to deliver heating current to the filament. The return path of the current is through the conductor 38, the switch contact 40, the bimetal strip 42, and the stationary electrode 44 to the conductor 32.

In operation, as voltage is applied between the conductors 30 and 32, the current flows through the heater 36. The generation of heat in the heater 36 causes the bimetal strip 42 to index about the stationary end 44 and to separate at its free end 43 from the stationary contact 40. Once the electrical connection between contact 40 and end 43 of bimetal strip 42 has occurred, the flow of current between the conductors 30 and 32 is terminated. The switch then starts to cool if there is no other source of heat.

Figure 2:
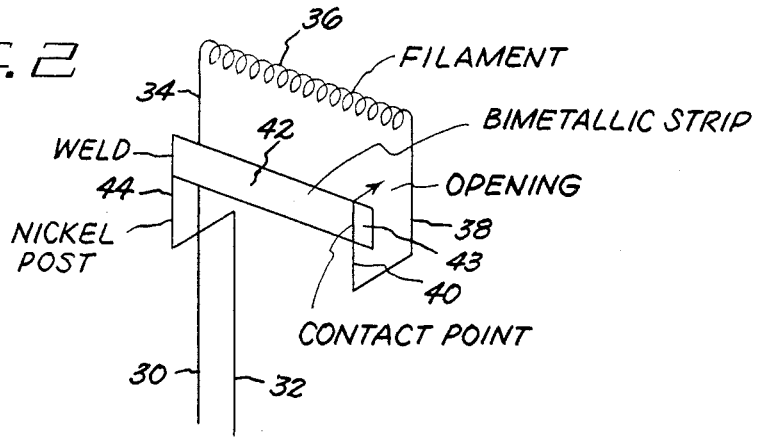
FIG. 2 is a semi-schematic perspective view of one arrangement of elements for a thermally responsive bimetal switch.

When a thermally responsive switch as just described with reference to FIG. 2 is in place in a fluorescent tube, it will be continuously heated by the flow of current through the gas of the tube and will accordingly stay open so long as the gas of the tube remains ignited.

A number of problems exist for a switch such as illustratively described with reference to FIG. 2 where the bimetallic strip 42 is of conventional construction.

I have now found that a relative idealized behavior of a bimetal actuated fluorescent lamp switch may be approximated by making use of binary alloys displaying Curie Temperatures which are a sensitive function of alloy composition. One such system is the Fe-Ni binary system and includes the Fe-Ni binary system in the range of 25 to 45 wt % Ni. The thermal coefficients of expansion of materials of this system as a function of composition and temperature are given in the text entitled "Ferromagnetism", authored by R. M. Bozworth and published by Van Nostrand Company, N.Y.C., N.Y. (1951). See page 106.

Figure 3:
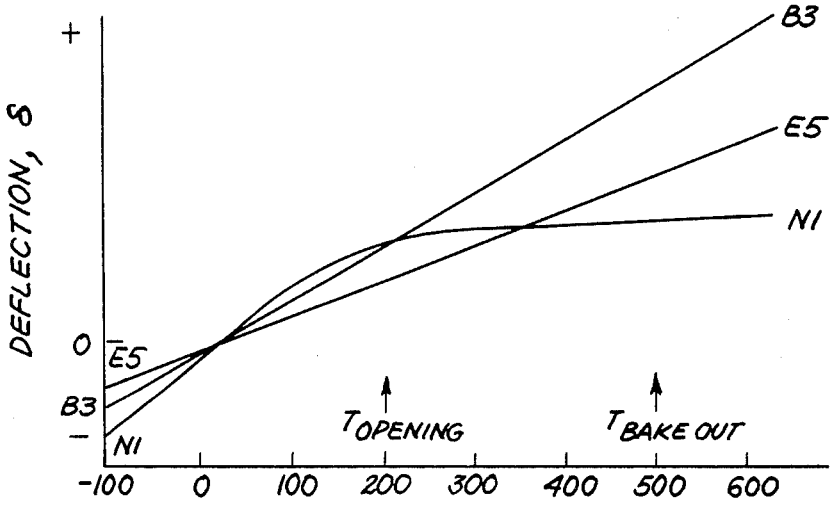
FIG. 3 is a graph of deflection against temperature for a number of bimetal materials.
Figure 5:
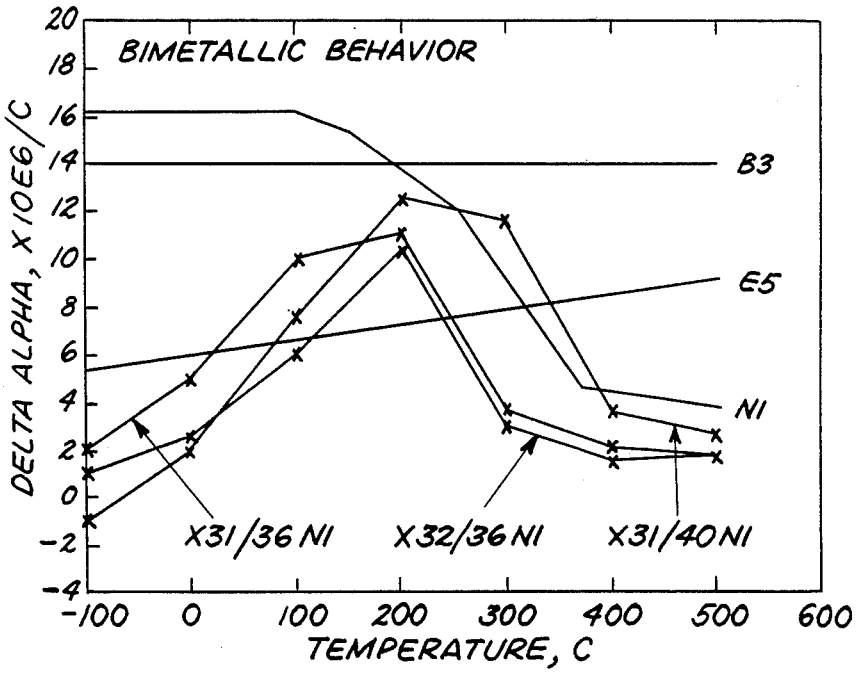
FIG. 5 is a set of plots of differential deflection versus temperature for a number of different candidate bimetal materials.

Referring next to FIG. 5, there is illustrated the differential thermal coefficients for the three commercial bimetallic alloys B3, E5 and N1 discussed above with reference to FIG. 3. Also, illustrated on the same set of coordinates are the thermal coefficients for the three bimetallics, (A), (B) and (C), constructed from the iron-nickel system as employed in the present invention. The three bimetallics from this system which have been chosen are as follows:

(A) Fe-31Ni/Fe-40Ni,
(B) Fe-31Ni/Fe-36Ni, and
(C) Fe-32Ni/Fe-36Ni.

Figure 4:
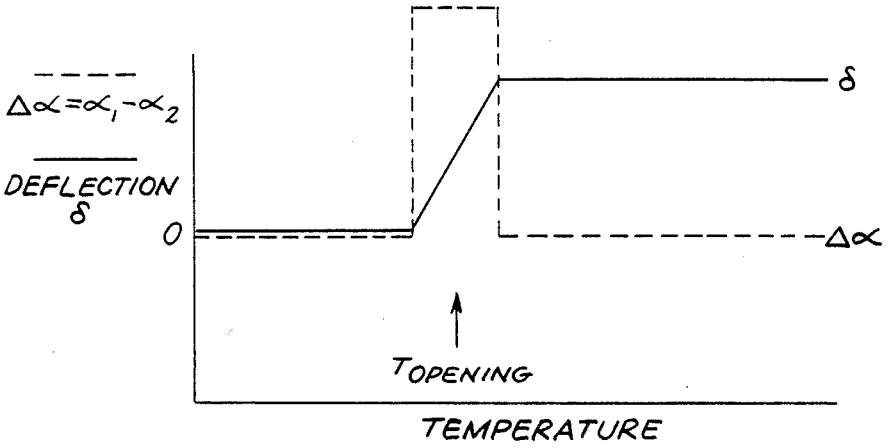
FIG. 4 is a solid line graph of deflection and a dashed line graph of differential deflection of a bimetal based on temperature plotted as abscissa.

It will be noted from the graph of FIG. 5 that these three bimetallics come close to approximating the idealized behavior displayed in FIG. 4 in that they exhibit large $\Delta\alpha$ values, that is, large displacements around the opening temperature of 200° C. but very small values of $\Delta\alpha$ at higher temperatures and also at lower temperatures. The speed of opening may be represented by the $\Delta\alpha$ at about 200° C. A set of values of $\Delta\alpha$ at 200° C. is given in Table I below for each of the alloys B3, E5, N1 as well as alloys A, B and C.

The peak thermal stresses generated are observed to be proportional to the interval of $\Delta\alpha\Delta T$. Table I below lists an estimate of the $\Delta\alpha\Delta T$ values from 200° C. to −50° C. and also the $\Delta\alpha\Delta T$ values from 200° C. to 500° C. These temperatures, i.e. −50° C. and 500° C. are respectively the minimum and maximum temperatures seen by a device as provided pursuant to this invention.

TABLE I

| Alloy | $\Delta\alpha$ at 200° C. $\times 10^{-6}$ | $\Delta\alpha\Delta T$ −50 to 200° C. | $\Delta\alpha\Delta T$ 200 to 500° C. |
|---|---|---|---|
| B3 | 14 | 3.5 | 4.2 |
| E5 | 7 | 1.6 | 2.4 |
| N1 | 14 | 3.8 | 2.1 |
| A | 7.5 | 1.5 | 2.1 |
| B | 11 | 2.0 | 1.23 |
| C | 10.5 | 1.25 | 1.1 |

It is apparent that the bimetallic combinations selected from the iron nickel system offer significantly lower total stress ranges, ($\Delta\alpha\Delta T$ at $-50°$ to $200°$ C. and at $200°$ to $500°$ C.) while still preserving rapid deflection characteristics ($\Delta\alpha$ at $200°$ C.) at the opening temperature.

The reduction in total deflections at the higher temperatures are deemed to be especially important in reducing creep effects.

Other combinations of alloys from this iron nickel system offer the possibility of selecting other preferred opening temperatures. Also, the incorporation of tertiary alloy elements may produce enhanced characteristics such as deflection/temperature or strength characteristics.

What is claimed and sought to be protected by Letters Patent of the United States is the following:

1. A thermally actuated switch resistant to thermally induced stresses from about $-100°$ C. to about $+600°$ C. which comprises a stationary and a movable contact member adapted to close to allow flow of current through said switch, a continuously movable arm anchored at one end and disposed to urge said movable contact into and out of electrical engagement with the stationary contact, said arm being formed of an iron-nickel bimetal of two iron-nickel bialloys in which the two metals of the bimetal are each selected from the Fe-Ni binary system in the range of 25 to 45 wt % Ni, said bimetal being adapted to low rates of movement at $-100°$ C. and at $+500°$ C. and being adapted to its highest rate of movement at about $200°$ C.

2. The switch of claim 1 in which the respective iron-nickel bialloys are about Fe-31 Ni/Fe-40/Ni.

3. The switch of claim 1 in which the respective iron-nickel bialloys are about Fe-31 Ni/Fe-36 Ni.

4. The switch of claim 1 in which the respective iron-nickel alloys are about Fe-32 Ni/Fe-36 Ni.

* * * * *